US011141982B2

(12) United States Patent
Mizuno

(10) Patent No.: US 11,141,982 B2
(45) Date of Patent: Oct. 12, 2021

(54) LIQUID EJECTION HEAD

(71) Applicant: Brother Kogyo Kabushiki Kaisha, Nagoya (JP)

(72) Inventor: Taisuke Mizuno, Yokkaichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/825,070

(22) Filed: Mar. 20, 2020

(65) Prior Publication Data

US 2020/0307225 A1 Oct. 1, 2020

(30) Foreign Application Priority Data

Apr. 1, 2019 (JP) ..... JP2019-069611

(51) Int. Cl.

| | |
|---|---|
| ***B41J 2/175*** | (2006.01) |
| ***B41J 2/18*** | (2006.01) |
| ***B41J 2/26*** | (2006.01) |
| ***B41J 2/295*** | (2006.01) |
| ***B41J 2/135*** | (2006.01) |
| ***B41J 2/045*** | (2006.01) |
| ***B41J 2/14*** | (2006.01) |

(52) U.S. Cl.

CPC ..... *B41J 2/175* (2013.01); *B41J 2/04581* (2013.01); *B41J 2/135* (2013.01); *B41J 2/14233* (2013.01); *B41J 2/18* (2013.01); *B41J 2/26* (2013.01); *B41J 2/295* (2013.01)

(58) Field of Classification Search

CPC .... B41J 2/04581; B41J 2/135; B41J 2/14233; B41J 2/175; B41J 2/17506; B41J 2/17523; B41J 2/18; B41J 2/26; B41J 2/295

See application file for complete search history.

(56) References Cited

U.S. PATENT DOCUMENTS

| | | | | |
|---|---|---|---|---|
| 7,850,290 | B2 * | 12/2010 | Nitta | B41J 2/17556 347/85 |
| 8,794,746 | B2 * | 8/2014 | Kashu | B41J 2/1433 347/66 |
| 10,076,912 | B2 | 9/2018 | Kanegae | |
| 2017/0305155 | A1 | 10/2017 | Kanegae | |
| 2019/0111679 | A1 * | 4/2019 | Hamano | B41J 2/1623 |

FOREIGN PATENT DOCUMENTS

| | | |
|---|---|---|
| JP | 2017-193132 A | 10/2017 |

* cited by examiner

*Primary Examiner* — Anh T Vo
(74) *Attorney, Agent, or Firm* — Banner & Witcoff, Ltd.

(57) ABSTRACT

A liquid ejection head includes pressure chambers arranged in a first direction, a common channel, and a communicating portion communicating with the common channel and each of the pressure chambers. The common channel includes a supply portion, a return portion, and a connection portion connecting them in a second direction crossing the first direction. The liquid ejection head has a first vector directed from the supply portion via the connection portion toward the return portion and has a component in the second direction. The second vector is directed from the common channel via the communicating portion toward each of the pressure chambers and has a component in the second direction. The component in the second direction of the first vector and the component in the second direction of the second vector point in the same direction.

21 Claims, 8 Drawing Sheets

LIQUID EJECTION HEAD

CROSS-REFERENCE TO RELATED APPLICATION

This application claims priority from Japanese Patent Application No. 2019-069611 filed on Apr. 1, 2019, the content of which is incorporated herein by reference in its entirety.

TECHNICAL FIELD

Aspects described herein relate to a liquid ejection head including a plurality of pressure chambers and a common channel communicating with the pressure chambers.

BACKGROUND

A known liquid ejection head includes a plurality of pressure chambers arranged in an X direction (a first direction), a manifold (a connection portion), a supply flow path (a supply portion), and an air bubble return flow path (a return portion). The manifold communicates with each of the pressure chambers and connects the supply flow path and the air bubble return flow path. The manifold communicates with each of the pressure chambers via a supply communicating path (a communicating portion).

SUMMARY

In the above liquid ejection head, a y-direction component (a component in a second direction) of a vector directed from the supply flow path via the manifold toward the air bubble return flow path and a y-direction component of a vector directed from the manifold via the communicating portion toward the pressure chambers point in opposite directions. In this case, the flow of ink directed from the supply flow path via the manifold toward the air bubble return flow path may hinder the flow of ink directed from the manifold via the communicating portion toward the pressure chambers, resulting in insufficient ink supply to the pressure chambers (an under-refilling phenomenon).

Aspects of the disclosure provide a liquid ejection head configured to reduce an under-refilling phenomenon.

According to one or more aspects of the disclosure, a liquid ejection head includes a plurality of pressure chambers arranged in a first direction, a common channel, and a communicating portion. The common channel extends in the first direction and includes a supply portion, a return portion, and a connection portion. The supply portion has a supply opening. The return portion has a return opening and is located alongside the supply portion in a second direction crossing the first direction. The connection portion connects the supply portion and the return portion in the second direction. The communicating portion communicates with the common channel and each of the pressure chambers. The liquid ejection head has a first vector and a second vector. The first vector is directed from the supply portion via the connection portion toward the return portion and has a component in the second direction. The second vector is directed from the common channel via the communicating portion toward each of the pressure chambers and has a component in the second direction. The component in the second direction of the first vector and the component in the second direction of the second vector point in the same direction.

DETAILED DESCRIPTION

First Embodiment

Figure 1:
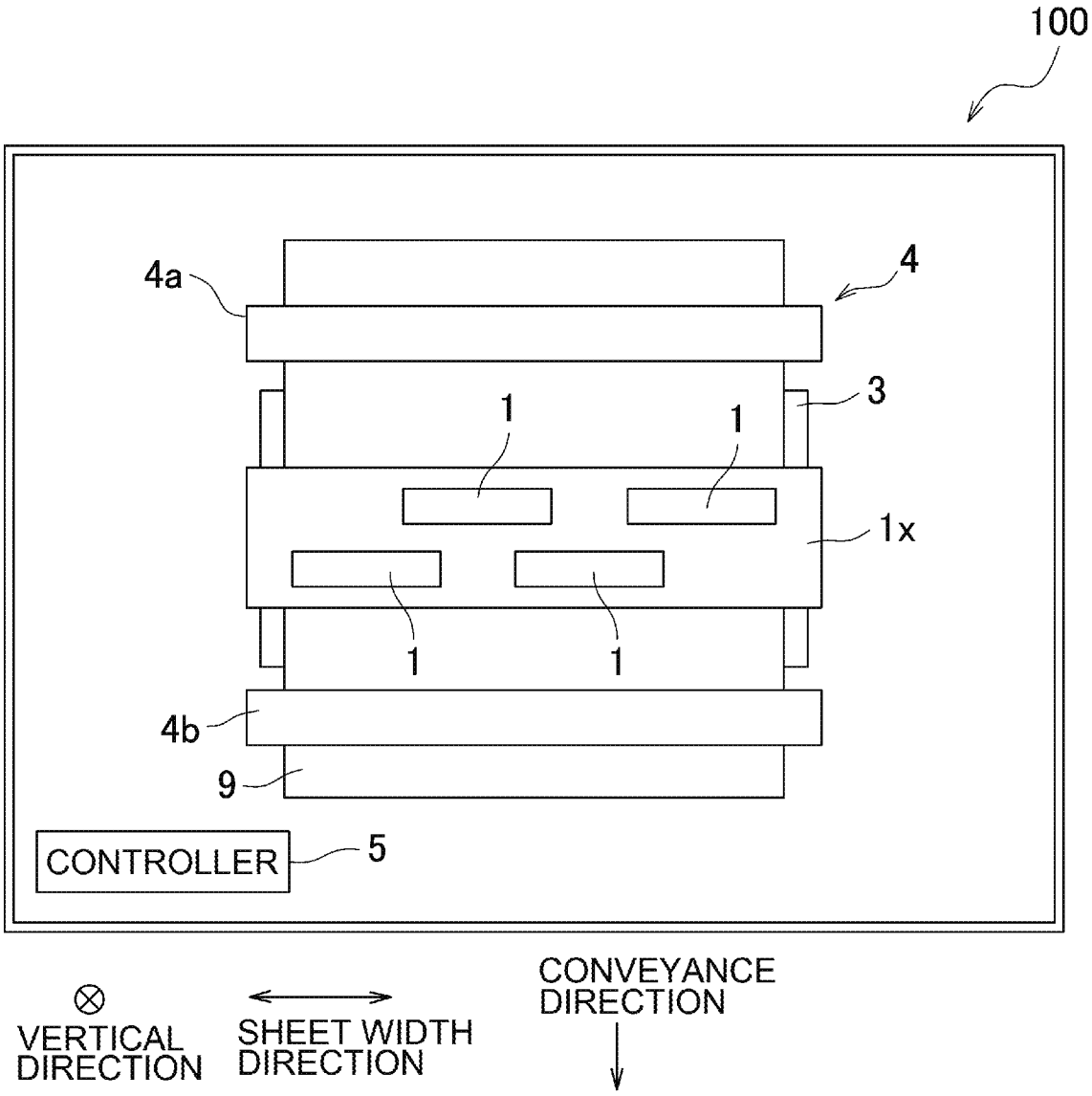
FIG. 1 is a plan view of a printer including a plurality of heads according to a first embodiment of the disclosure.

Referring to FIG. 1, an overall structure of a printer 100 including heads 1 according to a first embodiment of the disclosure will be described.

The printer 100 includes a head unit 1*x* with four heads 1, a platen 3, a conveyor 4, and a controller 5.

The platen 3 receives a sheet 9 on its upper surface.

Figure 5:
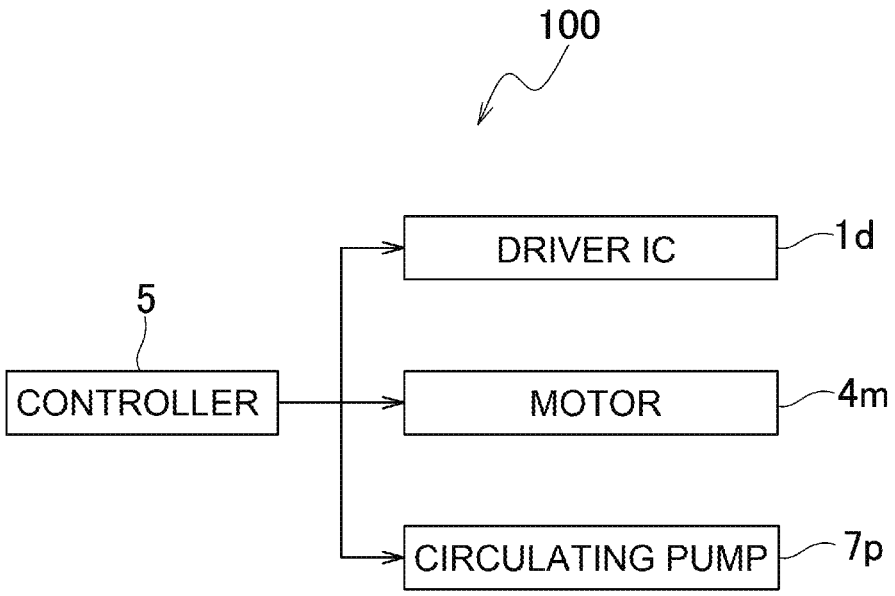
FIG. 5 is a block diagram illustrating an electrical system of the printer.

The conveyor 4 includes two roller pairs 4*a*, 4*b* which are disposed opposite to each other with the platen 3 therebetween in a conveyance direction. When a motor 4*m* (FIG. 5) is driven under control by the controller 5, the roller pairs 4*a*, 4*b* rotate while nipping the sheet 9 therebetween to convey the sheet 9 in the conveyance direction.

The head unit 1*x* is elongated in a sheet width direction, which is orthogonal to the conveyance direction and a vertical direction. The head unit 1*x* is of a line type in which ink is ejected from nozzles 21 at fixed positions (FIGS. 2 and 3) to a sheet 9 being conveyed. The four heads 1 are elongated in the sheet width direction and disposed in two rows in a staggered configuration in the sheet width direction.

The controller 5 includes ROM (read only memory), RAM (random access memory), and ASIC (application specific integrated circuit). The ASIC performs recording processing in accordance with programs stored in the ROM. In the recording processing, the controller 5 controls a driver IC 1*d* (FIG. 4) of each head 1 and a motor 4*m* (FIG. 5) with a recording command (including image data) input from an external device, for example, a PC, to record an image on the sheet 9.

Figure 2:
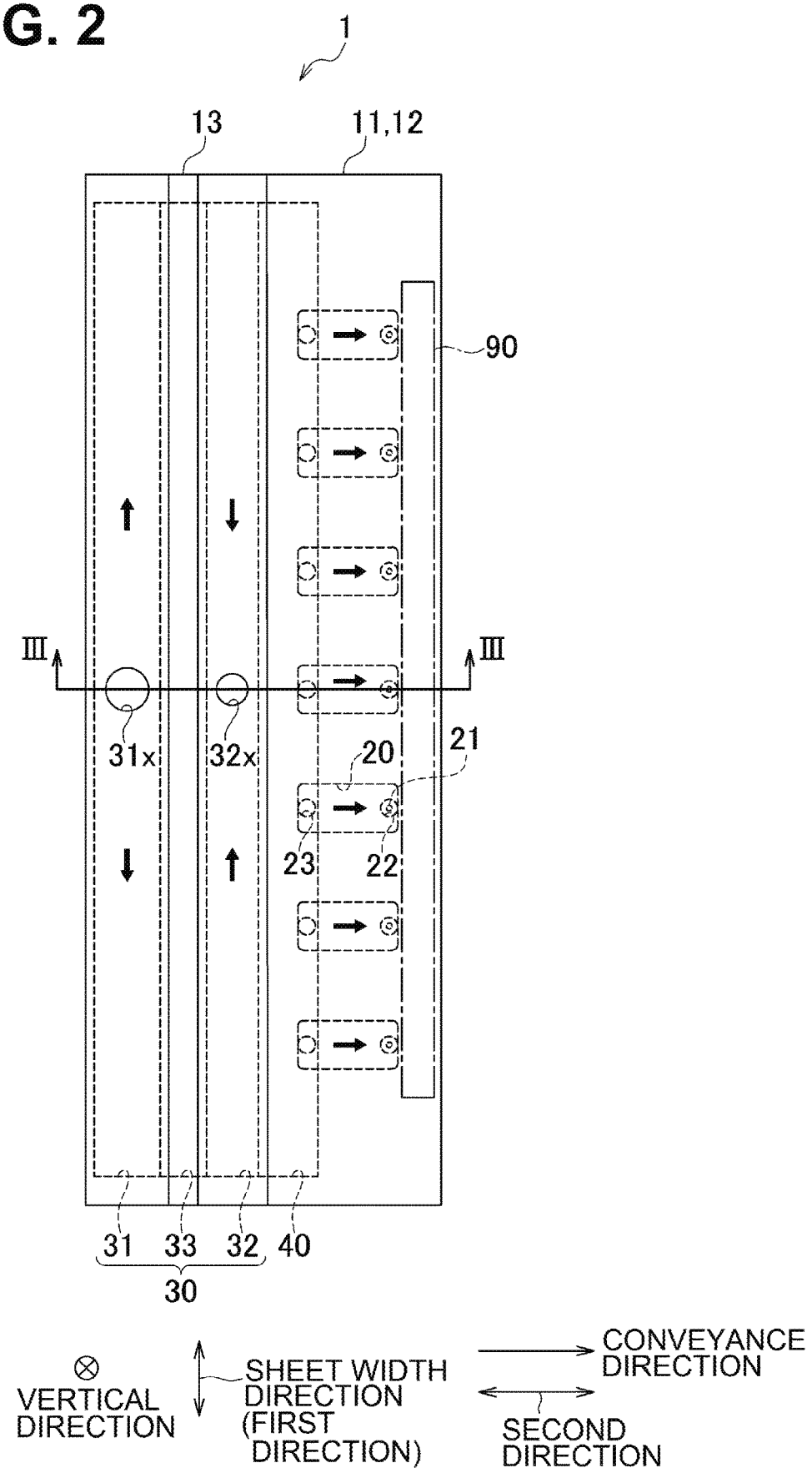
FIG. 2 is a plan view of a head.
Figure 3:
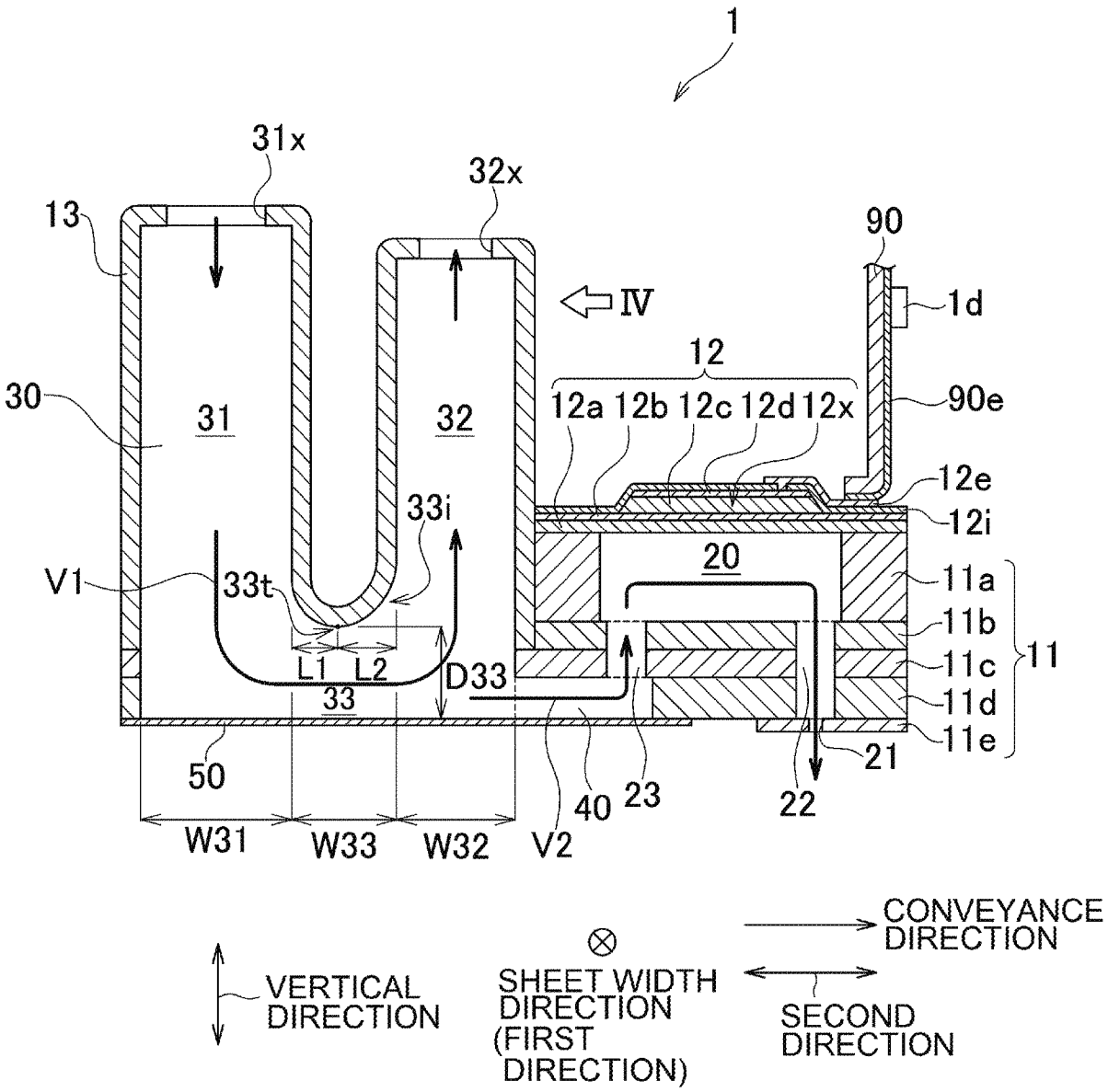
FIG. 3 is a sectional view of the head taken along a line III-III of FIG. 2.
Figure 4:
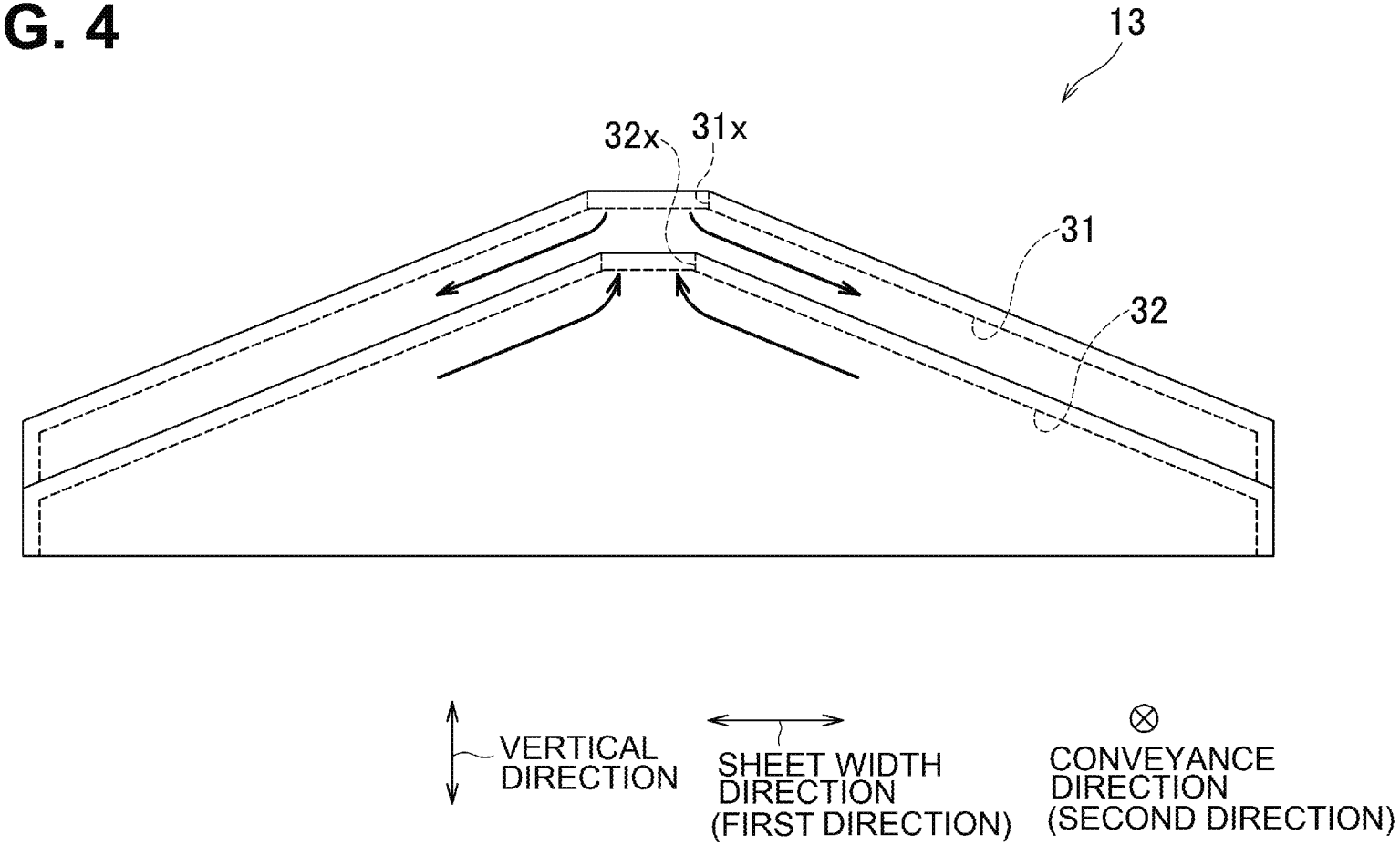
FIG. 4 is a side view of an upper part of a common channel member viewed from a direction IV of FIG. 3.

Referring to FIGS. 2, 3, and 4, a structure of a head 1 will be described.

As illustrated in FIGS. 2 and 3, a head 1 includes a channel substrate 11, an actuator substrate 12, a common channel member 13, and a wiring substrate 90.

The channel substrate 11 includes a plurality of pressure chambers 20, a plurality of nozzles 21, a plurality of connection channels 22, a plurality of link channels 23, a communicating portion 40, and a part of a common channel 30.

As illustrated in FIG. 3, the channel substrate 11 is made of five plates 11*a*-11*e*. The plates 11*a*-11*e* may be each made of silicon or metal.

The pressure chambers 20 are defined by through holes in an uppermost plate 11*a* of the plates 11*a*-11*e*. The plate 11*a* corresponds to a pressure-chamber substrate.

As illustrated in FIG. 2, the pressure chambers 20 are arranged in a single row in the sheet width direction (a first direction) and spaced uniformly. Each pressure chamber 20 has a rectangular shape elongated in a direction (a second direction) parallel to the conveyance direction on a plane orthogonal to the vertical direction. The first direction and the second direction are on a horizontal plane.

Each of the connection channels 22 is provided for a corresponding one of the pressure chambers 20. As illustrated in FIG. 3, each connection channel 22 extends downward from a first end (e.g., a right end in FIG. 3) of a corresponding pressure chamber 20 in the second direction, and connects the corresponding pressure chamber 20 and a nozzle 21. Each connection channel 22 is defined by through holes in the plates 11*b*-11*d*.

Each of the nozzles 21 is provided for a corresponding one of the pressure chambers 20. As illustrated in FIG. 3, each nozzle 21 is located directly below a corresponding connection channel 22. The nozzles 21 are defined by through holes in a lowermost plate 11*e* of the plates 11*a*-11*e*.

Each of the link channels 23 is provided for a corresponding one of the pressure chambers 20. As illustrated in FIG. 3, each link channel 23 extends downward from a second end (e.g., a left end in FIG. 3) of a corresponding pressure chamber 20 in the second direction. Each link channel 23 is defined by through holes in the plates 11*b*-11*c*.

The communicating portion 40 is provided in common for all pressure chambers 20 formed in the channel substrate 11. As illustrated in FIGS. 2 and 3, the communicating portion 40 extends in the first direction below the link channels 23. A first end of the communicating portion 40 in the second direction (e.g., a right end of the communicating portion 40 in FIG. 3) overlaps the link channels 23 and the second end of each pressure chamber 20 in the second direction (e.g., a left end of each pressure chamber 20 in FIG. 3). The communicating portion 40 is defined by a through hole in a plate 11*d*.

As illustrated in FIG. 3, of the five plates 11*a*-11*e* constituting the channel substrate 11, two plates 11*c*, 11*d* are longer in the second direction than upper plates 11*a*, 11*b*. Through holes in the two plates 11*c*, 11*d* define a part (a lower portion) of the common channel 30. Of the five plates 11*a*-11*e*, the lowermost plate 11*e* is smaller in the second direction than other plates 11*a*-11*d*.

The common channel member 13 may be made of, for example, resin, by injection molding, and is bonded to an upper surface of the plate 11*c*. The common channel member 13 forms a portion of the common channel 30 except for a remaining portion thereof formed by the plates 11*c*, 11*d*.

The common channel 30 is provided in common for all pressure chambers 20 formed in the channel substrate 11. As illustrated in FIGS. 2 and 3, the common channel 30 is located to a side of the communicating portion 40 in the second direction and extends in the first direction. The common channel 30 communicates with the pressure chambers 20 via the communicating portion 40 and the link channels 23.

The common channel 30 includes a supply portion 31, a return portion 32, and a connection portion 33. The supply portion 31, the return portion 32, and the connection portion 33 extend in the first direction and have the same length as the communicating portion 40 in the first direction.

The supply portion 31, the connection portion 33, and the return portion 32 are located alongside in this order in the second direction. The connection portion 33 connects the supply portion 31 and the return portion 32 in the second direction, and allows lower ends of the supply portion 31 and the return portion 32 to communicate with each other as illustrated in FIG. 3.

A damper film 50 is located below the common channel 30 (including the supply portion 31, the connection portion 33, and the return portion 32) and the communicating portion 40, defining their lower surfaces. The damper film 50 is bonded to a lower surface of the plate 11*d* so as to close a through hole formed in the plate 11*d* which defines a lower portion of the common channel 30 and the communicating portion 40.

As illustrated in FIGS. 2 and 3, the supply portion 31, the connection portion 33, the return portion 32, and each of the pressure chambers 20 are located alongside in this order in the second direction. The pressure chambers 20 are located to a side of the common channel 30 and do not overlap any of the supply portion 31, the connection portion 33, and the return portion 32 in the vertical direction.

As illustrated in FIG. 3, the communicating portion 40 is located below the pressure chambers 20 and alongside the connection portion 33 in the second direction.

An upper surface of the connection portion 33 is curved downward and includes an inclined portion 33*i* that is inclined relative to a horizontal plane. Specifically, the upper surface of the connection portion 33 is defined by a wall of the common channel member 13, and the wall is curved in U-shape when viewed in the first direction. The wall has a bottom portion (or the lowest portion 33*t* of the upper surface of the connection portion 33), which is closer to the supply portion 31 than to the return portion 32 in the second direction. In other words, a distance L1 in the second direction from the lowest portion 33*t* to the supply portion 31 is smaller than a distance L2 in the second direction from the lowest portion 33*t* to the return portion 32.

The connection portion 33 has a depth D33 (or a dimension in the vertical direction) smaller than a width W31 (or a dimension in the second direction) of the supply portion 31. In the connection portion 33, the depth D33 is the smallest. In this embodiment, the depth D33 is a distance in the vertical direction from a lower surface of the connection portion 33 to the lowest portion 33*t* of the upper surface of the connection portion 33.

The lowest portion 33*t* is located below an upper surface of the actuator substrate 12.

The return portion 32 has a width W32 (or a dimension in the second direction) smaller than the width W31 of the supply portion 31. The connection portion 33 has a width W33 (or a dimension in the second direction) smaller than any of the width W31 of the supply portion 31 and the width W32 of the return portion 32. Thus, the following relationship is satisfied: W31>W32>W33.

The supply portion 31 has a supply opening 31*x* in its upper surface. As illustrated in FIGS. 2 and 4, the supply opening 31*x* is located in a center of the supply portion 31 in the first direction.

The return portion 32 has a return opening 32*x* in its upper surface. As illustrated in FIGS. 2 and 4, the return opening 32*x* is located in a center of the return portion 32 in the first direction and at the same position as the supply opening 31*x* in the first direction.

As illustrated in FIGS. 3 and 4, the supply opening 31*x* is located above the return opening 32*x*.

As illustrated in FIG. 4, an upper surface of each of the supply portion 31 and the return portion 32 is inclined more downward at a distance farther away from a corresponding one of the supply opening 31*x* and the return opening 32*x* in the first direction. In other words, an upper surface thereof widens from a corresponding opening toward its ends in the first direction. Thus, a depth of each of the supply portion 31 and the return portion 32 is progressively smaller at a distance farther away from a corresponding one of the supply opening 31*x* and the return opening 32*x* in the first direction.

The supply opening 31*x* and the return opening 32*x* communicate with a sub tank (omitted from the drawings). The sub tank communicates with a main tank to store ink supplied from the main tank.

When a circulating pump is driven under control by the controller 5, ink in the sub tank is allowed to enter the supply portion 31 from the supply opening 31*x*.

Ink entering the supply portion 31 from the supply opening 31*x*, as illustrated in FIG. 4, moves progressively downward toward both ends of the supply portion 31 in the first direction, and enters, as illustrated in FIG. 3, a lower end of the return portion 32 from the lower end of the supply portion 31 through the connection portion 33.

Ink entering the lower end of the return portion 32 progressively moves upward as illustrated in FIG. 3 and toward the center of the return portion 32 in the first direction as illustrated in FIG. 4, and thus flows out from the return opening 32*x*. Ink flowing out from the return opening 32*x* is returned to the sub tank.

Ink is thus circulated between the sub tank and the common channel 30. The circulation of ink reduces problems such as air bubbles formed in the common channel 30 and an increased viscosity of ink. For ink having settling ingredients (e.g., pigments) which settle down and form a sediment, the circulation of ink between the sub tank and the common channel 30 stirs the settling ingredients, thus preventing the settling ingredients from accumulating at the lower end of the common channel 30.

As illustrated in FIG. 3, the actuator substrate 12 includes a vibrating plate 12*a*, a common electrode 12*b*, a plurality of piezoelectric members 12*c*, and a plurality of individual electrodes 12*d*, which are stacked one on another in this order from below.

The vibrating plate 12*a* and the common electrode 12*b* extend over an upper surface of the plate 11*a* of the channel substrate 11 and cover all the pressure chambers 20 formed in the channel substrate 11. A piezoelectric member 12*c* and an individual electrode 12*d* are provided for each pressure chamber 20 and overlap each pressure chamber 20 in the vertical direction.

The actuator substrate 12 further includes an insulating film 12*i* and a plurality of wires 12*e*.

The insulating film 12*i* is made of a material including silicon dioxide ($SiO_2$), and covers a portion of an upper surface of the common electrode 12*b* having no piezoelectric members 12*c*, side surfaces of the piezoelectric members 12*c*, and upper surfaces of the individual electrodes 12*d*. The insulating film 12*i* has a through hole at a position coinciding with the individual electrodes 12*d* in the vertical direction.

The wires 12*e* are formed on the insulating film 12*i*. The wires 12*e*, each with its one end in the through hole in the insulating film 12*i*, are electrically connected to a corresponding one of the individual electrodes 12*d*. The wires 12*e* extends to one end of the actuator substrate 12 in the second direction.

The wiring substrate 90 has one end located on one end of the actuator substrate 12 in the second direction. The wiring substrate 90 has the other end connected to the controller 5. A driver IC 1*d* is disposed between the one end and the other end of the wiring substrate 90.

The wiring substrate 90 is a chip-on-film (COF) substrate and extends in the first direction on the upper surface of the actuator substrate 12 (FIG. 2). The wiring substrate 90 includes a plurality of individual wires 90*e* (FIG. 3) each electrically connected to a corresponding one of the wires 12*e*, and a common wire (omitted from the drawings). The common wire passes through the through hole in the insulating film 12*i* and is electrically connected to the common electrode 12*b*.

The driver IC 1*d* is connected to each of the individual electrodes 12*d* via a corresponding one of the individual wires 90*e*, and to the common electrode 12*b* via the common wire. The driver IC 1*d* maintains the potential of the common electrode 12*b* at a ground potential, while changing the potential of each of the individual electrodes 12*d*. Specifically, the driver IC 1*d* generates drive signals based on control signals from the controller 5 and transmits the drive signals to the individual electrodes 12*d*. The potential of each of the individual electrodes 12*d* thus changes between a specified drive potential and a ground potential. At this time, an individual electrode 12*d* whose potential is changed to a drive potential causes a corresponding piezoelectric member 12*c* to become deformed, and thus a portion of the actuator substrate 12 that is sandwiched between the individual electrode 12*d* and the vibrating plate 12*a* and that overlaps the deformed piezoelectric member 12*c* in the vertical direction (that is, an actuator 12*x*) protrudes toward a corresponding pressure chamber 20. The capacity of the pressure chamber 20 is thus changed and ink in the pressure chamber 20 is pressurized and ejected, in form of ink droplets, from the nozzle 21 communicating with the pressure chamber 20.

Ink is ejected from the nozzles 21 in form of ink droplets after being supplied from the common channel 30 via the communicating portion 40 to the pressure chambers 20. Specifically, as illustrated in FIG. 3, ink in the common channel 30 moves through the connection portion 33 in the second direction, and enters the connection portion 40. Ink entering the communicating portion 40 moves upward through the link channels 23, and enters the pressure chambers 20 from their second ends (e.g., left ends in FIG. 3). Ink in each of the pressure chambers 20 moves from the second end to the first end, passes down through a corresponding connection channel 22, and is ejected from its associated nozzle 21 in form of ink droplets.

In FIG. 3, a vector V1 (as an example of a first vector) represents a flow rate of ink directed from the supply portion 31 via the connection portion 33 toward the return portion 32, and a vector V2 (as an example of a second vector) represents a flow rate of ink directed from the common channel 30 via the communicating portion 40 toward each of the pressure chambers 20. A component in the second direction of the vector V1 and a component in the second direction of the vector V2 point in the same direction (rightward in FIG. 3). Thus, the flow of ink circulating through the common channel 30 (or the flow of ink directed from the supply portion 31 via the connection portion 33 toward the return portion 32) is unlikely to hinder the flow of ink being ejected (or the flow of ink directed from the common channel 30 via the connection portion 40 toward the pressure chambers 20), thus preventing an under-refilling phenomenon.

The connection portion 33 allows the lower ends of the supply portion 31 and the return portion 32 to communicate with each other (FIG. 3). For ink having settling ingredients, ink flowing along the lower end of the common channel 30 may prevent the settling ingredients from accumulating at the lower end of the common channel 30.

The upper surface of the connection portion 33 includes the inclined portion 33*i*, which is inclined relative to a horizontal plane (FIG. 3). If the upper surface of the connection portion 33 is flat (and parallel to a horizontal plane), it may be likely to allow air bubbles to collect thereon. In this embodiment, however, ink flows along the inclined portion 33*i*, thus preventing air bubbles from collecting on the upper surface of the connection portion 33.

The upper surface of the connection portion 33 is curved downward and defines the inclined portion 33*i* (FIG. 3). If the upper surface of the connection portion 33 is not curved but straightened or inclined straight (FIG. 8), a pressure loss may become high at the lowest portion of the upper surface, and ink flow may become less smooth. Resin is difficult to form an angular inclined portion with an acute angle. Even if an acute angle is formed, burrs at the tip of the acute angle may drop and close the connection portion 33. In this embodiment, however, the upper surface of the connection portion 33 is curved. This obviates the need to increase a pressure loss at a limited part and allows ink to smoothly flow along the curved upper surface. As there is no need to form an acute angle, formation of the inclined portion 33*i* is easy and unlikely to have a problem due to burrs.

The distance L1 in the second direction from the lowest portion 33*t* to the supply portion 31 is smaller than the distance L2 in the second direction from the lowest portion 33*t* to the return portion 32 (FIG. 3). According to this embodiment, ink smoothly flows to the return portion 32, and air bubbles in ink are smoothly discharged from the return portion 32.

The width W33 of the connection portion 33 is smaller than any of the width W31 of the supply portion 31 and the width W32 of the return portion 32 (FIG. 3). When the width W33 of the connection portion 33 is greater than any of the width W31 of the supply portion 31 and the width W32 of the return portion 32, settling ingredients may accumulate in the connection portion 33. In this embodiment, however, as the width W33 of the connection portion 33 is smaller than any of the width W31 of the supply portion 31 and the width W32 of the return portion 32, ink smoothly flows in the connection portion 33, thus preventing the settling ingredients from accumulating in the connection portion 33.

The depth D33 (or a dimension in the vertical direction) of the connection portion 33 is smaller than the width W31 (or a dimension in the second direction) of the supply portion 31 (FIG. 3). When the depth D33 of the connection portion 33 is greater than the width W31 of the supply portion 31, ink flow may become less smooth near the lower end of the connection portion 33, and settling ingredients may accumulate near the lower end of the connection portion 33. In this embodiment, however, as the depth D33 of the connection portion 33 is smaller than the width W31 of the connection portion 33, ink smoothly flows in the connection portion 33, thus preventing the settling ingredients from accumulating near the lower end of the connection portion 33.

The width W32 (or a dimension in the second direction) of the return portion 32 is smaller than the width W31 of the supply portion 31 (FIG. 3). According to this embodiment, the flow rate of ink in the return portion 32 increases, and air bubbles in ink are discharged from the return portion 32.

The pressure chambers 20 do not overlap any of the supply portion 31, the connection portion 33, and the return portion 32 in the vertical direction. In other words, the pressure chambers 20 are located to a side of the common channel 30. If the pressure chambers 20 are located below any of the supply portion 31, the connection portion 33, and the return portion 32, ink may circulate through the common channel 30 above the pressure chambers 20. This may hinder the flow of ink to the pressure chambers 20, causing an under-refilling phenomenon. When the flow of ink circulating through the common channel 30 does not reach the pressure chambers 20, the settling ingredients are likely to accumulate near the pressure chambers 20. In this embodiment, however, ink circulates through the common channel 30 at a side of the pressure chambers 20. This enables ink to smoothly flow to the pressure chambers 20, thus reducing the above problems such as the under-refilling phenomenon and accumulation of settling ingredients.

The supply portion 31, the connection portion 33, the return portion 32, and each of the pressure chambers 20 are located alongside in this order in the second direction (FIG. 3). This embodiment ensures that the common channel 30 is located to a side of each of the pressure chambers 20 and the components in the second direction of both the vectors V1, V2 point in the same direction.

The communicating portion 40 is located below the pressure chambers 20 and alongside the connection portion 33 in the second direction (FIG. 3). According to this embodiment, ink flowing from the supply portion 31 via the connection portion 33 toward the return portion 32 smoothly enters the communicating portion 40, and then flows to each of the pressure chambers 20. This prevents the occurrence of the under-refilling phenomenon.

The damper film 50 is located below the supply portion 31, the connection portion 33, and the return portion 32, defining their lower surfaces (FIG. 3). This embodiment uses a larger sized damper film and obtains a more efficient damping effect than a structure where a small-sized damper film is provided on each side surface of the supply portion 31, the connection portion 33, and the return portion 32.

The actuator substrate 12 is disposed on the upper surface of the plate 11*a* formed with the pressure chambers 20, and the wiring substrate 90 extends in the first direction on the upper surface of the actuator substrate 12 (FIG. 3). In this embodiment, as the common channel 30 is located not above but to a side of each of the pressure chambers 20, a space enough for disposing the wiring substrate 90 is left above the pressure chambers 20.

The lowest portion 33*t* of the connection portion 33 is located below the upper surface of the actuator substrate 12 (FIG. 3). According to this embodiment, ink circulating through the common channel 30 flows in a lower area of the head 1, thus preventing accumulation of settling ingredients.

The return portion 32 has the return opening 32*x* in its upper surface (FIGS. 3 and 4). According to this embodiment, air bubbles in ink can be effectively discharged as they smoothly flow to the return opening 32*x* due to buoyancy.

The supply opening 31*x* in the upper surface of the supply portion 31 is located above the return opening 32*x* (FIGS. 3 and 4). As the supply opening 31*x* is provided in the upper surface of the supply portion 31, entry of air bubbles from the supply opening 31*x* can be prevented. A difference in height between the supply opening 31*x* and the return opening 32*x* effects protection against entry of air bubbles from the supply opening 31*x* and discharge of air bubbles from the return opening 32*x*.

The upper surface of each of the supply portion 31 and the return portion 32 is inclined more downward at a distance farther away from a corresponding one of the supply opening 31*x* and the return opening 32*x* in the first direction (FIG. 4). As ink goes farther away from the supply opening 31*x* and the return opening 32*x* in the first direction, the ink flow rate becomes lower, and a sediment is more likely to accumulate. In this embodiment, however, the upper surface of each of the supply portion 31 and the return portion 32 is inclined more downward, and the depth of each of the supply portion 31 and the return portion 32 is progressively smaller at a distance farther away from a corresponding one of the supply opening 31*x* and the return opening 32*x* in the first direction. This prevents the ink flow rate from lowering. According to this embodiment, a sediment is unlikely to accumulate, and thus ink smoothly flows from the supply opening 31*x* to the entire of the supply portion 31, and from the return portion 32 to the return opening 32*x*.

The supply opening 31*x* is located in the center of the supply portion 31 in the first direction and the return opening 32*x* is located in the center of the return portion 32 in the first direction (FIGS. 2 and 4). When the supply opening 31*x* and the return opening 32*x* are located at one end in the first direction of each of the supply portion 31 and the return portion 32, flow resistance may be different between one end and the other end in the first direction of each of the supply portion 31 and the return portion 32. In this case, flow resistance may be different between a pressure chamber 20 located at one end in the first direction and a pressure chamber 20 located at the other end in the first direction, causing variations in ejection performance. According to this embodiment, however, the supply opening 31*x* is located in the center of the supply portion 31 in the first direction and the return opening 32*x* is located in the center of the return portion 32 in the first direction. This prevents a difference in flow resistance between one end and the other end in the first direction of each of the supply portion 31 and the return portion 32, and thus reduces the variations in ejection performance.

Second Embodiment

Figure 6:
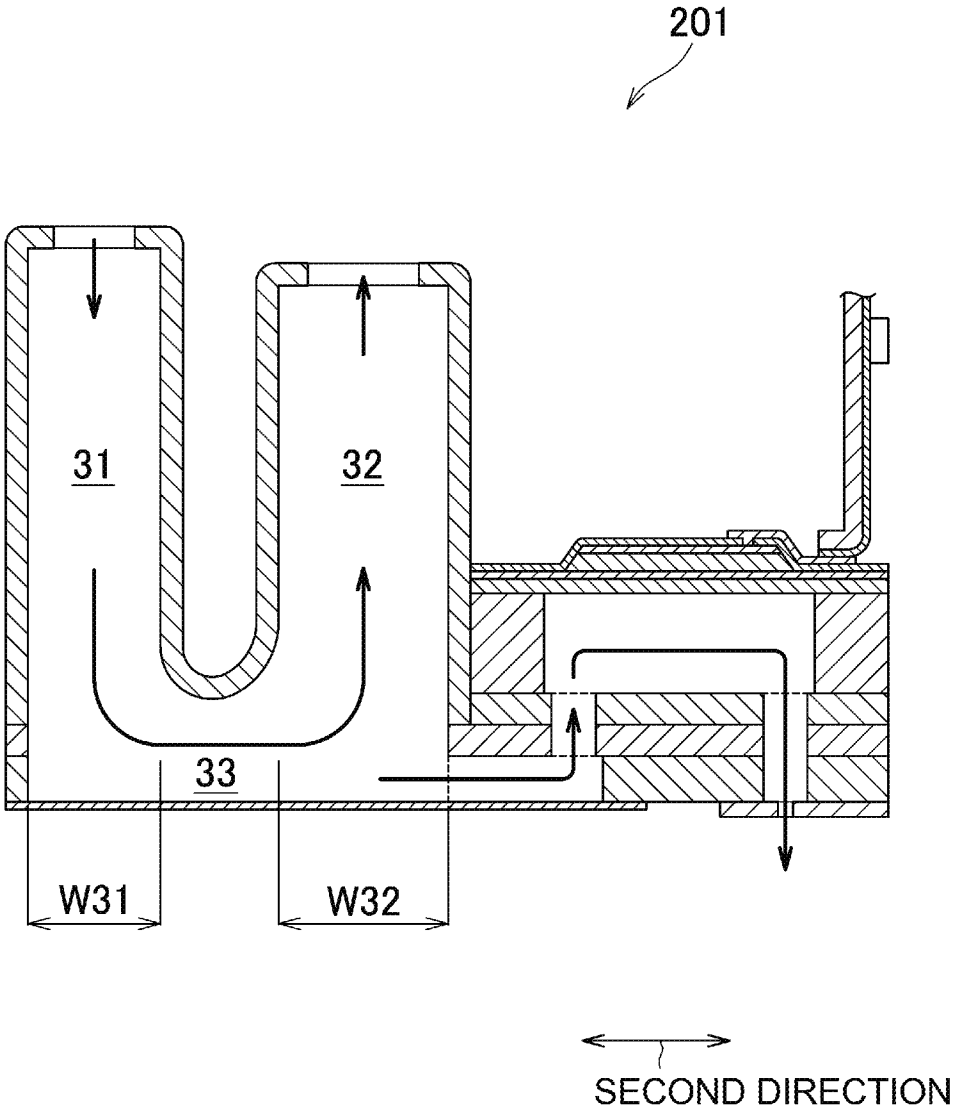
FIG. 6 is a sectional view of a head according to a second embodiment, corresponding to FIG. 3.

Referring to FIG. 6, a head 201 according to a second embodiment of the disclosure will be described. In the second embodiment, elements illustrated and described in the first embodiment are designated by the same reference numerals, and thus the description thereof will be omitted.

In the second embodiment, the width W31 (or a dimension in the second direction) of the supply portion 31 is smaller than the width W32 of the return portion 32 (FIG. 6), while, in the first embodiment, the width W32 of the return portion 32 is smaller than the width W31 of the supply portion 31 (FIG. 3).

According to this embodiment, as the ink flow rate becomes high in the supply portion 31 and a direction of a vector of ink flowing at high rate changes in the connection portion 33, a turbulence is likely to occur in the connection portion 33. The turbulence stirs the settling ingredients, effectively preventing accumulation of the settling ingredients.

Third Embodiment

Figure 7:
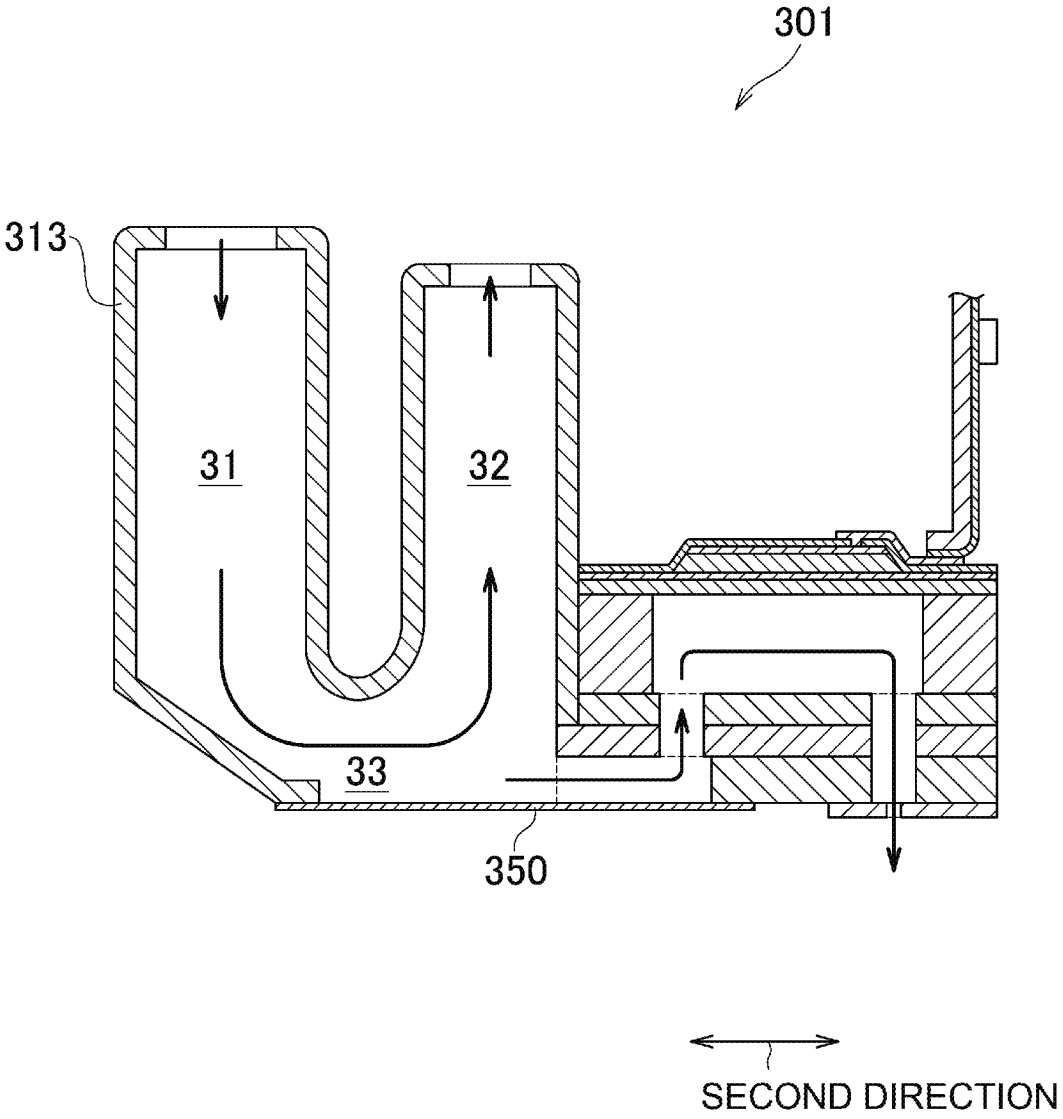
FIG. 7 is a sectional view of a head according to a third embodiment, corresponding to FIG. 3.

Referring to FIG. 7, a head 301 according to a third embodiment of the disclosure will be described. In the third embodiment, elements illustrated and described in the first embodiment are designated by the same reference numerals, and thus the description thereof will be omitted.

In the third embodiment, the lower surface of the supply portion 31, which is flat in the first embodiment (FIG. 3), is inclined (FIG. 7).

Specifically, in this embodiment, the lower surface of the supply portion 31 is inclined more downward at a distance from the supply portion 31 closer to the return portion 32 in the second direction. A common channel member 313 has a bent wall that defines an inclined lower portion of the supply portion 31. A damper film 350 is located below the connection portion 33 and the return portion 32, defining their lower surfaces. The damper film 350 is not located below the supply portion 31.

According to this embodiment, the lower surface of the supply portion 31 is inclined. This inclination may prevent the settling ingredients, which forms a sediment, from accumulating on the lower surface of the supply portion 31 and prevent the viscosity of ink from increasing.

Fourth Embodiment

Figure 8:
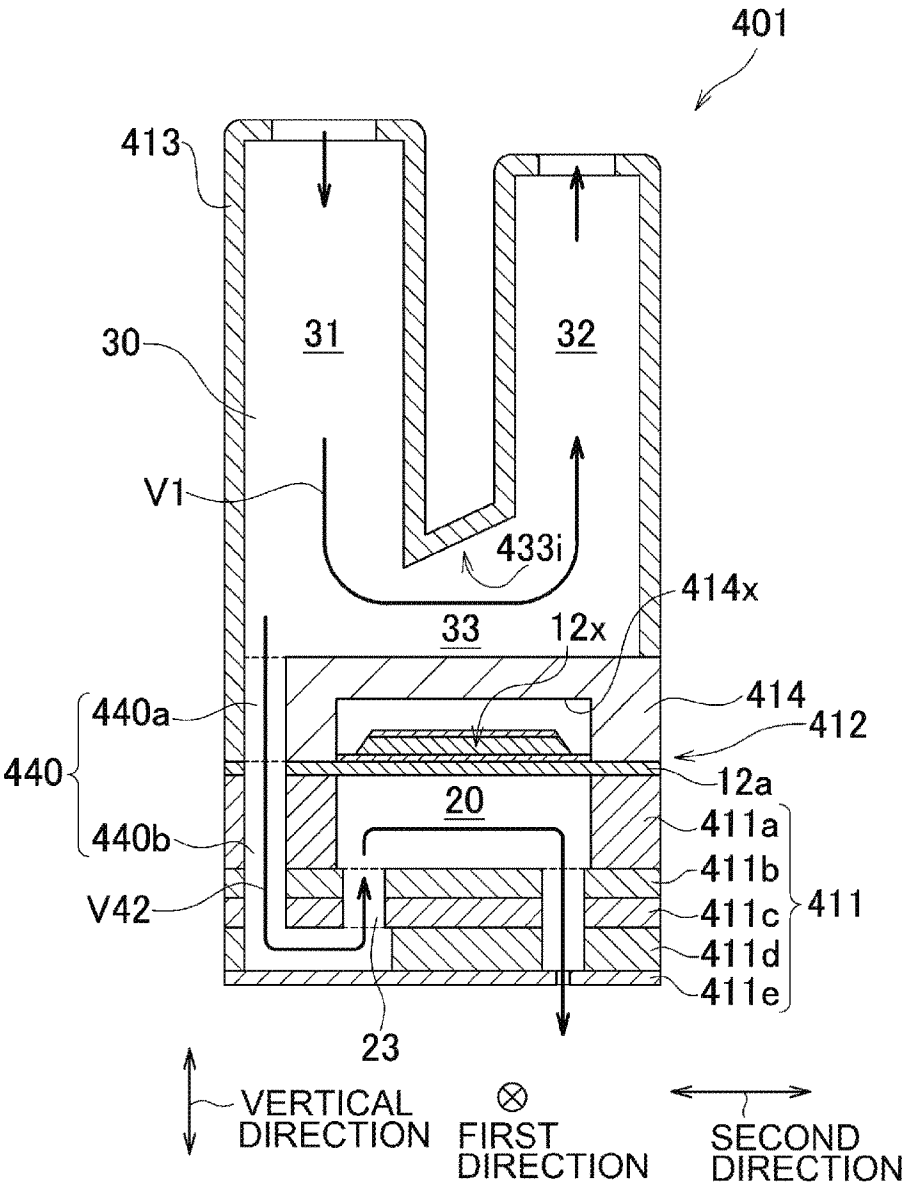
FIG. 8 is a sectional view of a head according to a fourth embodiment, corresponding to FIG. 3.

Referring to FIG. 8, a head 401 according to a fourth embodiment of the disclosure will be described. In the fourth embodiment, elements illustrated and described in the first embodiment are designated by the same reference numerals, and thus the description thereof will be omitted.

In the fourth embodiment, the upper surface of the connection portion 33, which is curved in the first embodiment (FIG. 3), is straightened or inclined straight (FIG. 8). The upper surface of the connection portion 33 includes an inclined portion 433*i*, which is inclined relative to a horizontal plane. Specifically, in this embodiment, a common channel member 413 has a wall that defines the upper surface of the connection portion 33, and the wall is inclined upward in the second direction from the supply portion 31 toward the return portion 32. In this embodiment, ink flows along the inclined portion 433*i* of the connection portion 33, thus preventing air bubbles from collecting on the upper surface of the connection portion 33.

In this embodiment, the head 401 is devoid of the damper film 50 (FIG. 3).

In this embodiment, the pressure chambers 20, which are located to a side of the common channel 30 in the first embodiment (FIG. 3), are located below the common channel 30 (FIG. 8).

Specifically, in this embodiment, a channel substrate 411 is made of five plates 411*a*-411*e*. The pressure chambers 20 are defined by through holes in an uppermost plate 411*a* of the plates 411*a*-411*e*.

An actuator substrate 412 is disposed on an upper surface of the plate 411*a*. A protective substrate 414 is disposed on an upper surface of a vibrating plate 12*a* on the actuator substrate 412. A lower surface of the protective substrate 414 has a recess 414*x*. The recess 414*x* extends in the first direction and coincides with the pressure chambers 20 in the vertical direction. The recess 414*x* stores a plurality of actuators 12*x* therein. The common channel member 413 is bonded to the upper surface of the protective substrate 414 and the upper surface of the vibrating plate 12*a* on the actuator substrate 412.

A communicating portion 440 is provided in common for all pressure chambers 20 formed in the channel substrate 411. The communicating portion 440 includes a first communicating portion 440*a* and a second communicating portion 440*b*. The first communicating portion 440*a* is formed between a side wall of the common channel member 413 and a side wall of the protective substrate 414 and extends downward from the lower end of the supply portion 31. The second communicating portion 440*b* is formed in the channel substrate 411. The second communicating portion 440*b* includes a particular portion extending downward from the lower end of the first communicating portion 440*a* and another portion extending from the particular portion in the second direction and being located below a plurality of link channels 23.

Although illustration is omitted in this embodiment, the wiring substrate 90 (FIGS. 2 and 3) may be bonded to any portion which does not overlap the common channel member 413 nor the protective substrate 414 in the vertical direction, of the upper surface of the actuator substrate 412.

In this embodiment, a vector V1 (as an example of a first vector) represents a flow rate of ink directed from the supply portion 31 via the connection portion 33 toward the return portion 32, and a vector V42 (as an example of a second vector) represents a flow rate of ink directed from the common channel 30 via the communicating portion 440 toward each of the pressure chambers 20. A component in the second direction of the vector V1 and a component in the second direction of the vector V42 point in the same direction (rightward in FIG. 8). Thus, as with the above embodiments, the flow of ink circulating through the common channel 30 (or the flow of ink directed from the supply portion 31 via the connection portion 33 toward the return portion 32) is unlikely to hinder the flow of ink being ejected (or the flow of ink directed from the common channel 30 via the communicating portion 440 toward the pressure chambers 20), thus preventing an under-refilling phenomenon.

Also in this embodiment, a vertical direction component of the vector V1 and a vertical direction component of the vector V42 point in the same direction (downward in FIG. 8). Thus, this embodiment achieves the above effects (which the flow of ink circulating through the common channel 30 is unlikely to hinder the flow of ink being ejected and thus the occurrence of an under-refilling phenomenon is prevented).

Alternative Embodiments

The above embodiments are merely examples. Various changes, arrangements and modifications may be applied therein without departing from the spirit and scope of the disclosure.

The second direction is not limited to being orthogonal to the first direction, but may cross the first direction.

The connection portion is not limited to allowing the lower ends of the supply portion and the return portion to communicate with each other. For example, the connection portion may allow central portions of the supply portion and the return portion in the vertical direction to communicate with each other.

When the upper surface of the connection portion includes an inclined portion, a distance in the second direction from the lowest portion of the upper surface of the connection portion to the supply portion may be greater than or equal to a distance in the second direction from the lowest portion to the return portion.

The upper surface of the connection portion is not limited to including an inclined portion, but may be flat (parallel to a horizontal plane).

The dimension in the second direction of the connection portion may be equal to the dimension in the second direction of the supply portion or the return portion. The dimension in the vertical direction of the connection portion may be greater than or equal to the dimension in the second direction of the supply portion.

The lowest portion of the upper surface of the connection portion may be level with or higher than the upper surface of the actuator substrate.

The upper surfaces of the supply portion and the return portion are not limited to being inclined as illustrated in FIG. 4, but may be flat (parallel to a horizontal plane).

The supply opening may be located at one end of the supply portion 31 in the first direction, and the return opening may be located at one end of the return portion in the first direction. The supply opening is not limited to being located above the return opening, but may be located level with or below the return opening. The supply opening and the return opening are not limited to being provided at the upper surfaces of the supply portion and the return portion, but may be provided at lower surfaces or side surfaces of the supply portion and the return portion.

The damper film is not limited to being located at the lower surface of the common channel, but may be located at a side surface thereof.

The communicating portion is provided in common for all pressure chambers in the above embodiments, but may be provided for each of the pressure chambers.

The pressure chambers are arranged in a single row in the above embodiments, but a plurality of rows of pressure chambers may be provided. In this case, one common channel may be provided in common for all rows of pressure chambers. Alternatively, one common channel may be provided for each row of pressure chambers.

In the above embodiments, a single nozzle communicates with each pressure chamber. However, two or more nozzles may communicate with each pressure chamber. In the above embodiments, a single nozzle is provided for a single pressure chamber. However, a single nozzle may be provided for two or more pressure chambers.

The actuator is not limited to a piezoelectric actuator with piezoelectric elements, but may be other type actuators, such as a thermal actuator using a thermal element, and an electrostatic actuator using electrostatic force.

The heads are not limited to line heads. The heads may be serial heads (which eject liquid droplets to a target object from nozzles while moving in a scanning direction parallel to the sheet width direction).

The target object is not limited to a sheet of paper, but may be, for example, a cloth, a substrate, and other materials.

A liquid to be ejected from nozzles in form of droplets is not limited to ink, but may be any liquids, for example, a process liquid for condensation or precipitation of an ink component.

The disclosure may be applied to not only printers but also other apparatus such as a facsimile, a copier, and a multifunction apparatus. The disclosure may be applied to various liquid ejection devices intended for, not only image recording on sheets, but also conductive pattern forming on substrates to form conductive patterns on substrates by ejecting a conductive liquid thereto.

What is claimed is:

1. A liquid ejection head comprises:

a plurality of pressure chambers arranged in a first direction;

a common channel extending in the first direction and including:

a supply portion having a supply opening;

a return portion having a return opening and being located alongside the supply portion in a second direction crossing the first direction; and a connection portion connecting the supply portion and the return portion in the second direction; and a communicating portion communicating with the common channel and each of the pressure chambers, wherein a first vector is directed from the supply portion via the connection portion toward the return portion and has a component in the second direction, wherein a second vector is directed from a junction between the communicating portion and the return portion via the communicating portion toward each of the pressure chambers and has a component in the second direction, and wherein the component in the second direction of the first vector and the component in the second direction of the second vector point in the same direction.

2. The liquid ejection head according to claim 1, wherein the first direction and the second direction are on a horizontal plane, and wherein the connection portion of the common channel allows a lower end of the supply portion and a lower end of the return portion to communicate with each other.

3. The liquid ejection head according to claim 2, wherein an upper surface of the connection portion includes an inclined portion that is inclined relative to the horizontal plane.

4. The liquid ejection head according to claim 3, wherein the upper surface of the connection portion is curved downward and defines the inclined portion.

5. The liquid ejection head according to claim 3, wherein a distance in the second direction from a lowest portion of the upper surface of the connection portion to the supply portion is smaller than a distance in the second direction from the lowest portion of the upper surface to the return portion.

6. The liquid ejection head according to claim 2, wherein the connection portion has a dimension in the second direction smaller than any of a dimension in the second direction of the supply portion and a dimension in the second direction of the return portion.

7. The liquid ejection head according to claim 2, wherein the connection portion has a dimension in a vertical direction smaller than a dimension in the second direction of the supply portion.

8. The liquid ejection head according to claim 2, wherein the return portion has a dimension in the second direction smaller than a dimension in the second direction of the supply portion.

9. The liquid ejection head according to claim 2, wherein the supply portion has a dimension in the second direction smaller than a dimension in the second direction of the return portion.

10. The liquid ejection head according to claim 2, wherein the pressure chambers do not overlap any of the supply portion, the connection portion, and the return portion in a vertical direction.

11. The liquid ejection head according to claim 10, wherein the supply portion, the connection portion, the return portion, and each of the pressure chambers are located alongside in this order in the second direction.

12. The liquid ejection head according to claim 10, wherein the communicating portion is located below the pressure chambers and alongside the connection portion in the second direction.

13. The liquid ejection head according to claim 10, further comprising a damper film located below the supply portion, the connection portion, and the return portion, the damper film defining lower surfaces of the supply portion, the connection portion, and the return portion.

14. The liquid ejection head according to claim 10, further comprising:

a pressure-chamber substrate formed with the pressure chambers;

an actuator substrate disposed on an upper surface of the pressure-chamber substrate and having a plurality of actuators each disposed above a corresponding one of the pressure chambers; and a wiring substrate extending in the first direction on an upper surface of the actuator substrate, the wiring substrate being electrically connected to the actuators.

15. The liquid ejection head according to claim 14, wherein a lowest portion of an upper surface of the connection portion is located below the upper surface of the actuator substrate.

16. The liquid ejection head according to claim 2, wherein the pressure chambers and the communicating portion are located below the common channel, wherein the communicating portion is connected to the lower end of the supply portion, wherein the first vector has a vertical direction component directed from the supply portion to the connection portion, wherein the second vector has a vertical direction component directed from the supply portion to the communicating portion, and wherein the vertical direction component of the first vector and the vertical direction component of the second vector point in the same direction.

17. The liquid ejection head according to claim 2, wherein the return opening is provided in an upper surface of the return portion.

18. The liquid ejection head according to claim 17, wherein the supply opening is provided in an upper surface of the supply portion and is located above the return opening.

19. The liquid ejection head according to claim 18, wherein the upper surface of the supply portion is inclined more downward at a distance farther away from the supply opening in the first direction, and wherein the upper surface of the return portion is inclined more downward at a distance farther away from the return opening in the first direction.

20. The liquid ejection head according to claim 17, wherein the supply opening is located in a center of the supply portion in the first direction, and wherein the return opening is located in a center of the return portion in the first direction.

21. The liquid ejection head according to claim 2, wherein a lower surface of the supply portion is inclined more downward at a distance from the supply portion closer to the return portion in the second direction.

* * * * *